US006679999B2

(12) United States Patent
Iyengar et al.

(10) Patent No.: US 6,679,999 B2
(45) Date of Patent: Jan. 20, 2004

(54) MR FLUIDS CONTAINING MAGNETIC STAINLESS STEEL

(75) Inventors: Vardarajan R. Iyengar, Beavercreek, OH (US); Robert T. Foister, Rochester, MI (US); James C. Johnson, Beavercreek, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/805,084

(22) Filed: Mar. 13, 2001

(65) Prior Publication Data

US 2002/0130305 A1 Sep. 19, 2002

(51) Int. Cl.[7] ..... C04B 35/00; C09K 3/00; H01F 1/28

(52) U.S. Cl. ..... 252/62.52; 252/62.56; 252/62.53; 252/62.54; 252/62.55; 252/500

(58) Field of Search ..... 252/62.52, 62.53, 252/62.54, 62.55, 62.56, 500

(56) References Cited

U.S. PATENT DOCUMENTS

| | | | | |
|---|---|---|---|---|
| 4,957,644 A | | 9/1990 | Price et al. | |
| 4,992,190 A | | 2/1991 | Shtarkman | |
| 5,354,488 A | | 10/1994 | Shtarkman et al. | |
| 5,382,373 A | | 1/1995 | Carlson et al. | |
| 5,578,238 A | | 11/1996 | Weiss et al. | |
| 5,599,474 A | | 2/1997 | Weiss et al. | |
| 5,645,752 A | | 7/1997 | Weiss et al. | |
| 5,667,715 A | | 9/1997 | Foister | |
| 5,842,547 A | * | 12/1998 | Calrson et al. | 188/164 |
| 5,906,767 A | | 5/1999 | Karol et al. | |
| 5,985,168 A | | 11/1999 | Phule | |
| 5,989,447 A | | 11/1999 | Podszun et al. | |
| 6,027,664 A | | 2/2000 | Weiss et al. | |
| 6,132,633 A | | 10/2000 | Carlson | |
| 6,186,290 B1 | * | 2/2001 | Carlson | 188/164 |
| 6,395,193 B1 | | 5/2002 | Kintz et al. | 252/62.52 |

OTHER PUBLICATIONS

Hamill et al., *Fine Particle Atomization Technology*, Eurotech Conference Proceedings, Munich. Oct. 1999.

* cited by examiner

*Primary Examiner*—Yogendra N. Gupta
*Assistant Examiner*—Derrick G Hamlin
(74) *Attorney, Agent, or Firm*—Scott A. Bain

(57) ABSTRACT

A magnetorheological fluid formulation exhibiting consistently high yield stress during use. The MR fluid comprises martensitic or ferritic stainless steel particles prepared by a controlled water or inert gas atomization process. The stainless steel particles are resistant to corrosion and oxidation, are generally smooth and spherical, and maintain their shape and size distribution throughout their use under an applied magnetic field.

15 Claims, 2 Drawing Sheets

MR FLUIDS CONTAINING MAGNETIC STAINLESS STEEL

FIELD OF THE INVENTION

This invention relates to magnetorheological fluids.

BACKGROUND OF THE INVENTION

Magnetorheological (MR) fluids are substances that exhibit an ability to change their flow characteristics by several orders of magnitude and in times on the order of milliseconds under the influence of an applied magnetic field. An analogous class of fluids are the electrorheological (ER) fluids which exhibit a like ability to change their flow or Theological characteristics under the influence of an applied electric field. In both instances, these induced Theological changes are completely reversible. The utility of these materials is that suitably configured electromechanical actuators which use magnetorheological or electrorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts and in numerous electronically controlled force/torque transfer (clutch) devices.

MR fluids are noncolloidal suspensions of finely divided (typically one to 100 micron diameter) low coercivity, magnetizable solids dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about 0.5 to greater than 1.0 Tesla. At the present state of development, MR fluids appear to offer significant advantages over ER fluids, particularly for automotive applications, because the MR fluids are less sensitive to common contaminants found in such environments, and they display greater differences in Theological properties in the presence of a modest applied field, in particular, higher yield strengths and greater damping forces.

MR fluids contain noncolloidal solid particles that are often seven to eight times more dense than the liquid phase in which they are suspended. A typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

The magnetizable solid is typically particles of iron, cobalt, nickel or magnetic alloys thereof. The presently preferred magnetizable solid for automotive applications is carbonyl iron, which is a high purity iron with soft magnetic properties. The traditional methods of producing powdered iron are the carbonyl process, inert gas atomization and water atomization.

The carbonyl process involves the thermal decomposition of iron pentacarbonyl that yields high purity iron. The particles are smooth and generally spherical, with diameters typically in the range of 1–10 $\mu$m. However, carbonyl iron is liable to oxidize in use, in part due to its high level of purity. Oxidation of the carbonyl iron has been observed in MR fluids used in fan clutch and shock absorber applications, for example. Oxidation can occur as a result of exposure to high temperatures and/or moisture. Carbonyl iron powders typically begin to oxidize in air at temperatures well below 200° C. In a clutch application, for example, the MR fluid often reaches over 200° C. Oxidation of the iron particles can reduce the magnetorheological effect of the fluid by as much as 20% or more. Iron oxide exhibits poorer magnetic properties than pure carbonyl iron. Moreover, the yield stress for the MR fluid decreases over time, and this is believed to be a result of one or both of the oxidation of the carbonyl iron particles or a change in the shape and size distribution of the particles. This reduction in effectiveness can severely affect device performance.

Inert gas atomization produces spherical iron particles, but is relatively expensive due to the use of inert gases, such as argon, xenon, etc. Thus, the market lacks commercial suppliers of inert gas atomized iron particles. Water atomization of iron typically yields irregular, large particles. However, the process can be controlled to yield spherical, smooth particles of small diameters, and is relatively inexpensive compared to inert gas atomization and the carbonyl process. Two commercial sources for smooth, spherical, small diameter water atomized iron particles include Hoeganaes Corporation (N.J.) and Hoganas AB (Sweden). Water atomized iron powder has only recently become available, however, and thus is not currently used commercially in the MR fluid market. Carbonyl iron continues to be used, and oxidation of the magnetizable particles continues to be a problem with respect to the effectiveness of the MR fluids under long-term use.

There is thus a need to increase the resistance of MR fluids to oxidation to prevent reduction in MR fluid performance.

SUMMARY OF THE INVENTION

The present invention provides a magnetorheological fluid formulation that is resistant to oxidation and corrosion and maintains a high yield stress throughout its use under an applied magnetic field. The fluid formulation comprises a suspension of magnetizable stainless steel particles dispersed in a liquid vehicle. The stainless steel is either a ferritic grade or preferably a martensitic grade. The stainless steel powder is produced by a controlled water atomization process, which results in generally smooth, spherical particles having a mean diameter in the range of 8–25 $\mu$m. Alternatively, a controlled inert gas atomization process could also be used to produce powders of the desired morphology and size distribution.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
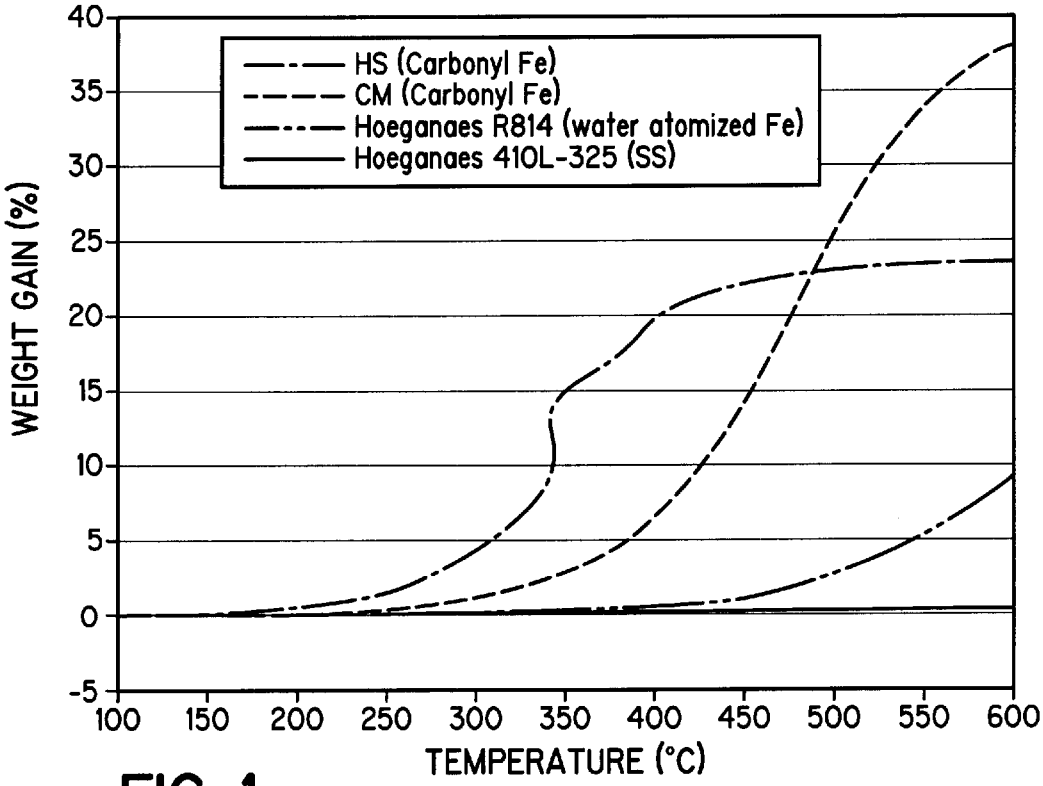
FIG. 1 is a graphical depiction of the variation in weight gain due to oxidation with increasing temperature for various iron powders and stainless steel powder.

The present invention provides a MR fluid having a consistent, high yield stress and high corrosion and oxidation resistance in use. To this end, and in accordance with the present invention, the MR fluid formulation comprises magnetizable stainless steel particles suspended in a liquid carrier or vehicle, the stainless steel being a ferritic or martensitic grade. In an exemplary embodiment of the present invention, the MR fluid comprises martensitic stainless steel particles dispersed in a liquid vehicle.

The magnetizable particles suitable for use in the fluids are magnetizable, low coercivity (i.e., little or no residual magnetism when the magnetic field is removed), finely divided particles of martensitic or ferritic stainless steel which are prepared by a controlled water or inert gas atomization process that results in a smooth, spherical or nearly spherical morphology and a diameter in the range of about 1 to 100 $\mu$m. Because the particles are employed in noncolloidal suspensions, it is preferred that a majority of particles be at the small end of the suitable range, preferably in the range of 1 to 25 $\mu$m in nominal diameter or particle size. Advantageously, the maximum particle size is less than 100 $\mu$m, and more advantageously less than 50 $\mu$m.

The stainless steel particles used in the MR fluid formulation of the present invention are produced by a controlled water or controlled inert gas atomization process. By "controlled" it is meant that the atomization parameters are selected so as to produce smooth, generally spherical particles of small diameter and narrow size distribution. One skilled in the art may appreciate that there are a number of key variables that influence the size and shape of the atomized particles. These variables include water or gas pressure, melt stream velocity and temperature, nozzle design, jet size, apex angle and water/metal ratios. By control of the various parameters, which is within the ordinary skill of one in the art, smooth, generally spherical stainless steel particles may be obtained with a narrow size distribution and a mean diameter in the range of about 8–25 $\mu$m.

Martensitic and ferritic stainless steel powders prepared by this controlled water or inert gas atomization process are particularly suitable for use as the magnetizable solid in MR fluids. Their magnetic performance is similar to carbonyl iron, but their oxidation resistance is significantly improved. Stainless steel powders prepared by normal water atomization have particles of irregular shape and average diameters of 50–100 $\mu$m. Conversely, stainless steel powders prepared by the controlled water or inert gas atomization process have smooth, generally spherical particles on the order of 20 $\mu$m average diameters, typically a 8–25 $\mu$m mean diameter distribution, making them ideal for MR fluids. The particle size distribution is also very narrow, with the majority of particles falling within the range of ±10 $\mu$m of the mean diameter. Also, due to the high cooling rates involved in water and gas atomization, the particles are in effect quenched, thereby increasing their hardness. While carbonyl iron has a hardness on the Rockwell B scale on the order of 50–60, stainless steels exhibit hardness on the order of Rockwell B 80 to Rockwell C 60. Martensitic and ferritic stainless steel particles thus have an increased ability to maintain their smooth, spherical shape and the initial size distribution, whereas carbonyl iron is softer and thus more liable to flatten or break apart. The magnetic properties of the MR fluid may deteriorate when the magnetizable particles change morphology during use. Thus, the ability to maintain shape and size distribution may correlate directly with the ability of the MR fluid to maintain its magnetic properties throughout its use. MR fluids of the present invention maintain a consistent yield stress throughout use, i.e., the force required to promote flow in the fluid does not decrease over time. Stainless steel particles are not so hard, however, as to cause undue wear on the device in which the MR fluid operates.

Martensitic stainless steel powder is particularly effective as the magnetizable solid. The martensitic grades of stainless steel are magnetizable and are amenable to heat treatment or quenching to increase hardness. As a result of processing by controlled water or inert gas atomization, the martensitic stainless steel powders have a hardness on the order of 40–60 Rockwell C. An MR fluid comprising this dispersed martensitic stainless steel powder exhibits an increasing yield stress as the magnetic field is applied, and the yield stress remains at a high, substantially constant value under a steadily applied magnetic field, with the particles maintaining their spherical shape and size distribution. At high temperatures, for example around 200° C. or more, or in the presence of moisture, the stainless steel does not oxidize, and therefore the magnetic properties of the magnetizable solid remain stable.

An exemplary martensitic stainless steel is type 410 (AISI designation). Other grades that may be used in the MR fluid formulation of the present invention include types 420, 414, 431, 440A, 440B and 440C. Different grades may be used in the MR fluid formulation depending on the desired application to obtain slightly different corrosion or magnetic properties. Water atomized martensitic stainless steel powders of the desired morphology and size distribution may be obtained, for example, from Hoeganaes Corp. (NJ) and Hoganas AB (Sweden). Inert gas atomized martensitic stainless steel powders of the desired morphology and size are not generally available commercially due to the considerable expense of such powders compared to similar water atomized particles, but would be suitable with respect to their properties if made available.

FIG. 1 graphically depicts the weight gain due to oxidation of two carbonyl iron powders (grades HS and CM from BASF Corp., NJ), produced by the thermal decomposition process, and an iron powder processed by controlled water atomization (grade R814 from Hoeganaes, NJ), each heated in air, compared with that of a martensitic stainless steel powder processed by controlled water atomization (grade 410L-325 from Hoeganaes, NJ) heated in air. The HS carbonyl iron powder began to gain weight at temperatures below 200° C., and the CM carbonyl iron powder began to gain weight below 250° C. The water atomized iron began to gain weight at temperatures above 400° C., and the type 410 stainless steel had no appreciable weight gain. This evidences the tendency of carbonyl iron to oxidize, since iron oxide has a higher molecular weight than iron thus accounting for the weight gain at increasing temperatures.

Figure 2:
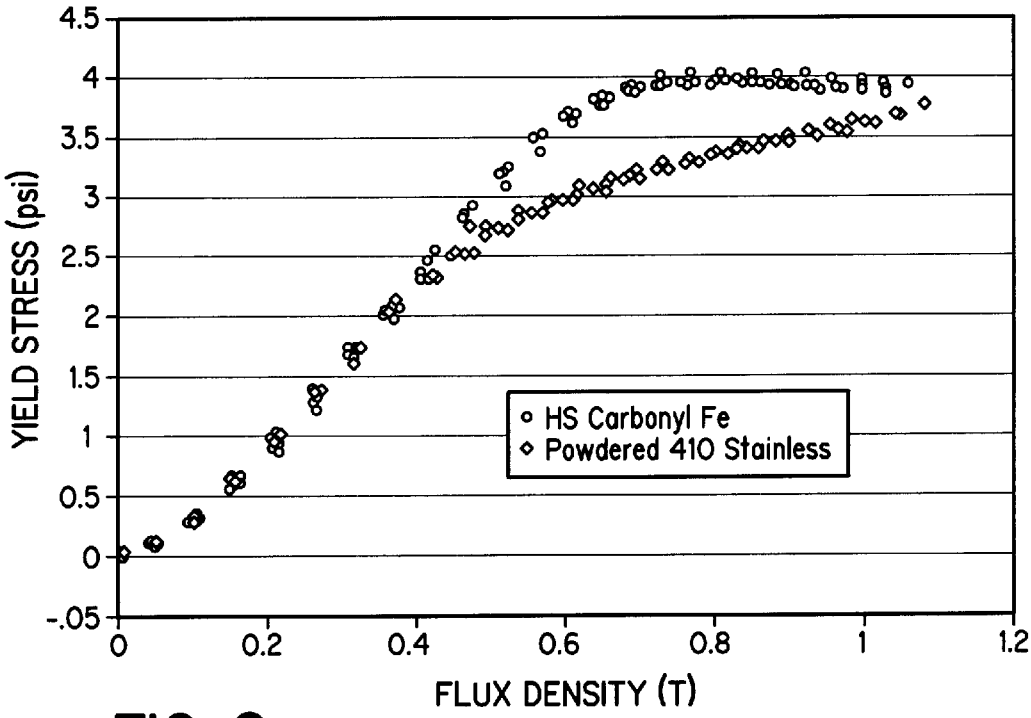
FIG. 2 is a graphical depiction of the variation in yield stress with increasing flux density for carbonyl iron and stainless steel.

FIG. 2 graphically depicts the change in yield stress as a magnetic field is applied to an MR fluid containing 20% by volume magnetizable solid. The yield stress was measured in a magnetic rheometer and is related to the magnetorheological effect in MR devices. FIG. 2 shows that the yield stress of the type 410 stainless steel based MR fluid is comparable to that of a grade HS carbonyl iron-based MR fluid at flux densities below 0.5 Tesla. At higher levels of flux density, the stainless steel-based MR fluid has a lower yield stress compared to the carbonyl iron-based MR fluid. At around 0.8 Tesla, the yield stress of the carbonyl iron-based MR fluid levels out, whereas the yield stress of the stainless steel-based MR fluid continues to increase until the two yield stresses reach approximately equivalent values around 1 Tesla. With continued use of the MR fluids under a magnetic field of about 1 Tesla, however, the stainless steel-based MR fluid is expected to maintain this yield stress, whereas the carbonyl iron-based MR fluid is expected to decrease as the particles change morphology and oxidize.

Figure 3:
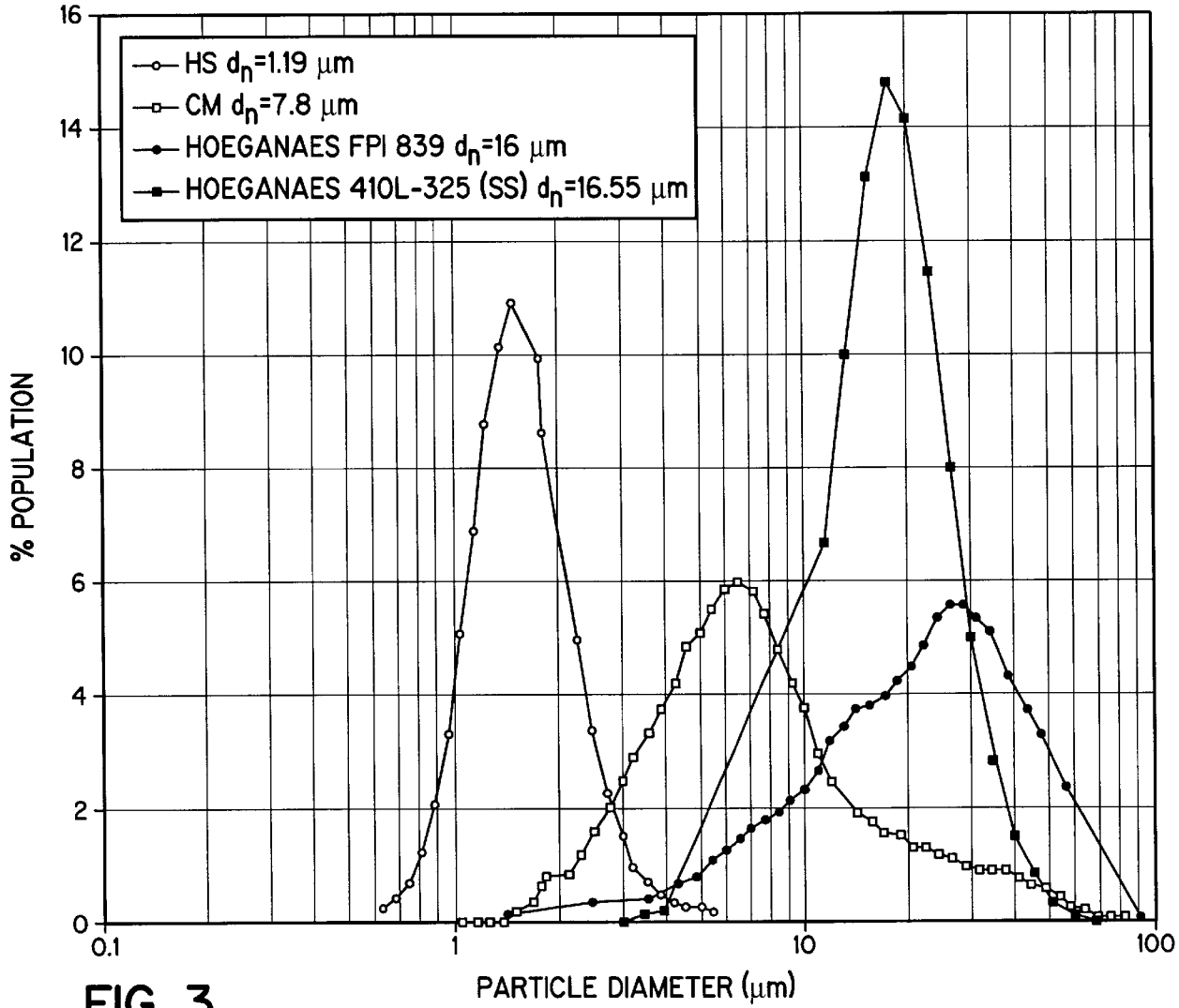
FIG. 3 is a graphical depiction of the particles size distributions for various iron powders and stainless steel powder.

FIG. 3 graphically depicts the particle size distribution of the martensitic type 410 stainless steel prepared by controlled water atomization (from Hoeganaes Corp.) compared to the size distributions of the grade HS and CM carbonyl iron powders (from BASF Corp.) and the type FPI 839 iron powder prepared by controlled water atomization (from Hoeganaes Corp.). The stainless steel powder exhibits the highest concentration of particles at and near the mean particle size. The narrow, fine particle distribution of the stainless steel powder makes it ideal for use in MR fluids.

Ferritic stainless steels may also be used as the magnetizable solid. The ferritic grades of stainless steel are also magnetizable, but are not amenable to heat treatment or quenching to increase hardness as with the martensitic grades. As a result of processing by controlled water or inert gas atomization, the ferritic stainless steel powders have a hardness on the order of 80–98 Rockwell B. An MR fluid comprising dispersed ferritic stainless steel powder is expected to exhibit an increasing yield stress as the magnetic field is applied, and the yield stress is expected to remain at a high, substantially constant value under a steadily applied magnetic field, with the particles substantially maintaining their spherical shape and size distribution. At high temperatures, for example around 200° C. or more, or in the presence of moisture, the stainless steel does not oxidize, and therefore the magnetic properties of the magnetizable solid remain stable. While the ferritic grades of stainless steel are softer than martensitic grades, and thus have a decreased ability to maintain their spherical shape, they have better corrosion resistance. With respect to magnetic properties, austenitic grades of stainless steel are not suitable for MR fluid applications; martensitic grades are ideally suited; and ferritic grades are suitable, but less so than martensitic grades.

An exemplary ferritic stainless steel is type 430 (AISI designation). Other grades that may be used in the MR fluid formulation of the present invention include types 442, 446, 409, 430F and 434. Different grades may be used in the MR fluid formulation depending on the desired application to obtain slightly different corrosion or magnetic properties.

The liquid vehicle or carrier phase may be any material which can be used to suspend the particles but does not otherwise react with the MR particles. Such liquids include but are not limited to water, hydrocarbon oils, other mineral oils, esters of fatty acids, other organic liquids, polydimethyl-siloxanes and the like. Particularly suitable and inexpensive liquids are relatively low molecular weight hydrocarbon polymer liquids as well as suitable esters of fatty acids that are liquid at the operating temperature of the intended MR device and have suitable viscosities for the off condition as well as for suspension of the MR particles. Polyalphaolefin (PAO) is a suitable base liquid for many MR applications in accordance with this invention. However, the polyalphaolefin does not have suitable lubricant properties for some applications. Therefore, PAO may be used in mixture with known lubricant liquids such as liquid alkyl ester-type fatty acids. Alternatively, such esterified fatty acids or other lubricant-type liquids may be employed with no PAO present. Examples of other suitable MR liquids include dioctyl sebacate and alkyl esters of tall oil type fatty acids. Methyl esters and 2-ethyl hexyl esters have been used. Saturated fatty acids with various esters including polyol esters, glycol esters and butyl and 2-ethyl hexyl esters have been tried and found suitable for use with the bimodal magnetic particles described in U.S. Pat. No. 5,667,715. Mineral oils and silicone liquids, e.g., Dow Chemical 200 Silicone Fluids, have also been used with bimodal particles as MR liquids.

The MR fluid formulation of the present invention may further include a thixotropic agent for better dispersibility and a surfactant to reduce the tendency for coagulation of the particles during utilization of MR fluids. Typical thixotropic agents include fumed silicas. Surfactants include known surfactants or dispersing agents such as ferrous oleate and naphthenate, metallic soaps (e.g., aluminum tristearate and distearate), alkaline soaps (e.g., lithium and sodium stearate), sulfonate, phosphate esters, stearic acid, glycerol monooleate, sorbitan sesquioleate, stearates, laurates, fatty acids, fatty alcohols, and other surface active agents. In addition, the surfactant may be comprised of stearic stabilizing molecules, including fluoro-aliphatic polymeric esters and titanate, aluminate or zirconate coupling agents. Also by way of example, the surfactant may be ethoxylated tallow alkyl amine, ethoxylated coco alkyl amine, ethoxylated oleyl amine, ethoxylated soya alkyl amine, ethoxylated octadecyl amine or an ethoxylated diamine such as ethoxylated -tallow-1,3-diamino propane.

In an example of the present invention, the magnetizable stainless steel particles may be coated ex situ with a surfactant. A tallow-amine surfactant (Ethomene T-15, manufactured by Akzo Chemical Company, Inc.) is selected for purposes of this example. The surfactant is first dissolved in PAO liquid vehicle (SHF 21, manufactured by Mobil Chemical Company). The stainless steel powder is then mixed with the surfactant solution for eight hours, after which the mixture is filtered and the surfactant coated iron particles recovered for use in formulating the MR fluid. The thixotropic agent, for example, fumed silica is then mixed, for example for about 10 minutes, under high shear conditions in the liquid vehicle and then degassed, for example for about 5 to 10 minutes. Then, solid magnetizable particles pretreated with surfactant are added to the thixotropic fluid and the final fluid mixed and degassed before use.

In an alternative embodiment of the present invention for preparing an MR fluid, the thixotropic fluid is pretreated with surfactant. After the thixotropic fluid is treated with the surfactant, solid magnetic particles are added to the fluid and the final fluid formulation is mixed for an appropriate time, for example 6–8 hours to effect an in situ coating of the magnetizable particles with surfactant. The fluid formulation is then degassed once again before use. Thus, the coating of magnetizable particles with surfactant is accomplished in situ, rather than first treating the stainless steel particles ex situ and adding them to the thixotropic fluid.

The magnetizable stainless steel particles of the present invention preferably comprise 5–60% by volume of the MR fluid, for example 10–55% by volume. For use in a shock absorber, for example, the particles advantageously comprise about 20–25% by volume of the MR fluid. For use in a clutch device, for example, the particles advantageously comprise about 40–55% by volume of the MR fluid. In addition to the liquid vehicle, the MR fluid may further comprise a thixotropic agent and a surfactant. Other known additives may be included in the MR fluid without departing from the scope of the present invention. However, it is noted that anti-oxidants would be unnecessary in the MR fluid of the present invention containing stainless steel particles, whereas such an additive is useful in carbonyl iron-containing MR fluids.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A magnetorhcological fluid formulation comprising magnetizable stainless steel particles selected from the group consisting of ferritic stainless steel and martensitic stainless steel dispersed in a liquid vehicle, wherein the magnetizable particles are prepared by controlled atomization and have a generally smooth, spherical shape and a mean diameter in the range of about 8–25 $\mu$m.

2. The formulation of claim 1, wherein the stainless steel particles are ferritic stainless steel of a grade selected from the group consisting of AISI designation types 430, 409, 442, 446, 430F and 434.

3. The formulation of claim 1, wherein the stainless steel particles are martensitic stainless steel of a grade selected from the group consisting of AISI designation types 410, 420, 414, 431, 440A, 440B and 440C.

4. The formulation of claim 1, wherein the stainless steel particles have a hardness in the range of about Rockwell B 80 to about Rockwell C 60.

5. The formulation of claim 1, wherein the magnetizable particles have a diameter in the range of about 1–100 $\mu$m.

6. The formulation of claim 1, wherein the magnetizable particles are prepared by controlled water atomization.

7. The formulation of claim 1, wherein the magnetizable particles are prepared by inert gas atomization.

8. The formulation of claim 1, wherein the liquid vehicle is selected from the group consisting of: water, hydrocarbon oils, mineral oils, esters of fatty acids, polydimethylsiloxanes, polyalphaolefins, dioctyl sebacate and silicone liquids.

9. The formulation of claim 1, further comprising a thixotropic agent.

10. The formulation of claim 1, further comprising a surfactant.

11. A magnetorheological fluid formulation comprising magnetizable martensitic stainless steel particles dispersed in a liquid vehicle, said particles prepared by controlled water atomization thereby having a generally smooth, spherical shape, a mean diameter in the range of about 8–25 $\mu$m, and a Rockwell C hardness of about 40–60.

12. The formulation of claim 11, wherein the martensitic stainless steel particles are of a grade selected from the group consisting of AISI designation types 410, 420, 414, 431, 440A, 440B and 440C.

13. The formulation of claim 11, wherein the liquid vehicle is selected from the group consisting of: water, hydrocarbon oils, mineral oils, esters of fatty acids, polydimethylsiloxanes, polyalphaolefins, dioctyl sebacate and silicone liquids.

14. The formulation of claim 11, further comprising a thixotropic agent.

15. The formulation of claim 11, further comprising a surfactant.

* * * * *